United States Patent [19]

Becker et al.

[11] Patent Number: 4,729,526

[45] Date of Patent: Mar. 8, 1988

[54] SLEEVE TYPE LAP CREEL HAVING A CHANGEABLE AXIAL LENGTH

[76] Inventors: Josef Becker; Hubert Becker; Matthias Becker, all of Niederforstbacher Str. 80-84, 5100 Aachen-Brand, Fed. Rep. of Germany

[21] Appl. No.: 919,796

[22] Filed: Oct. 16, 1986

[30] Foreign Application Priority Data

Nov. 2, 1985 [DE] Fed. Rep. of Germany ..... 3538861

[51] Int. Cl.[4] ..... B65H 75/24

[52] U.S. Cl. ..... 242/118.1; 68/198; 242/73

[58] Field of Search ..... 242/118.1, 118.11, 118, 242/118.2, 118.3, 118.31, 118.32, 118.4, 118.5, 73, 115; 68/189, 198

[56] References Cited

U.S. PATENT DOCUMENTS

| | | | |
|---|---|---|---|
| 974,127 | 11/1910 | Daniell et al. | 242/118.11 |
| 1,374,543 | 4/1921 | Ashworth | 242/118.1 X |
| 1,515,823 | 11/1924 | Benoit | 242/118.1 X |
| 3,740,976 | 6/1973 | Fyans | 242/118.1 X |
| 3,759,460 | 9/1973 | Fyans | 242/118.1 |
| 3,826,444 | 7/1974 | Hahn | 242/118.11 |
| 4,402,474 | 9/1983 | Henning | 242/118.1 |
| 4,441,665 | 4/1984 | Hahn | 242/118.1 |

FOREIGN PATENT DOCUMENTS 7102230 7/1971 Fed. Rep. of Germany .

*Primary Examiner*—Stanley N. Gilreath

*Attorney, Agent, or Firm*—W. G. Fasse; D. H. Kane, Jr.

[57] ABSTRACT

A sleeve type lap creel has two outer sleeve sections (1, 2) and an intermediate sleeve section (3) arranged in axial alignment with one another. The outer sections form substantially hollow cylinders. The intermediate section is formed by carrier ribs (8, 9) extending axially from each outer sleeve section toward the other sleeve section. The carrier ribs are circumferentially spaced so that the ribs of one outer sleeve section fit between the ribs of the other outer sleeve section. Initially, the ribs (8, 9) are fully extended and interconnected, for example axially or in the circumferential direction by frangible bridges (15). By pushing the outer sections toward each other the frangible bridges are broken and the ribs of one section move into the other section and vice versa. The ribs have projections (16) which fit into recesses (17) of the sleeve sections for arresting the ribs in the sleeve sections in a plurality of different positions, whereby the length of the lap creel is changeable. Both sections with their ribs can be made in the same mold.

16 Claims, 12 Drawing Figures

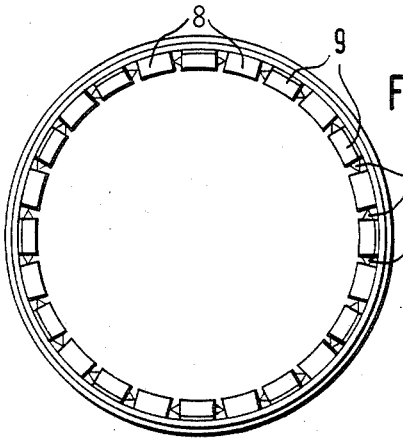
Fig. 6
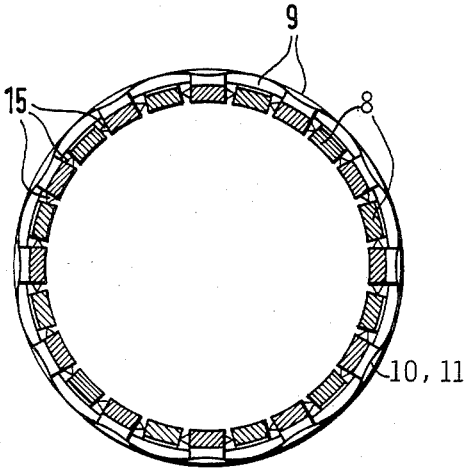
Fig. 7
Fig. 8
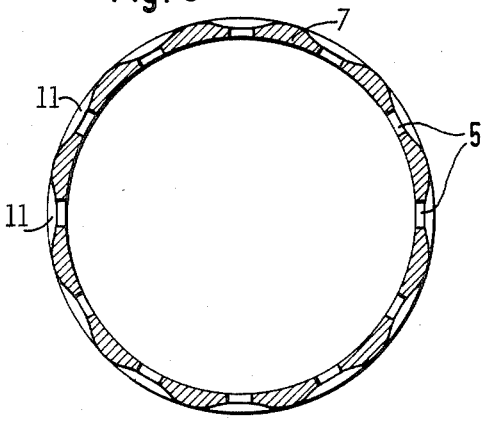

SLEEVE TYPE LAP CREEL HAVING A CHANGEABLE AXIAL LENGTH

FIELD OF THE INVENTION

The invention relates to a sleeve type lap creel having a changeable axial length. More specifically, the original full length of the lap creel may be shortened without any special tools.

DESCRIPTION OF THE PRIOR ART

A lap creel as disclosed in German Utility Model (DE-GM) 7,102,230 has two end sleeves each of which is equipped with axially extending, circumferentially spaced ribs. The ribs extend only from one end of each sleeve so that the ribs of one sleeve may be inserted into the spaces between the ribs of the other sleeve. This type of lap creel is intended for winding a coil of yarn onto the creel which is then shortened in its length to densify the yarn coil. The two sleeves with their axially extending ribs according to the above mentioned German Utility Model are not of identical construction because one sleeve with its ribs, of a pair of sleeves forming a complete lap creel, is provided with a support ring for the ribs while the other sleeve of the pair does not have such a support ring for the ribs. Accordingly, it is necessary to provide two different molding tools for the production of these lap creel sections of the prior art. The need for two tools makes these lap creels expensive. However, it is necessary that one of the two creel sections is constructed without a support ring for the ribs because otherwise it would not be possible to intermesh the ribs of one section with the ribs of the other section when the two sections are pushed axially toward each other. The limit for inserting the ribs of one section into the spaces between the ribs of the other section is provided when the ends of the ribs of one creel section contact an axially outer end ring of the other creel section and vice versa. Thus, the prior art sleeve type lap creel can be shortened from its original length to a length corresponding approximately to that of the ribs.

Thread type coils of textile material require a certain density or densification after winding for a uniform wet treatment, for example, in a dyeing bath. It is known to provide the densification by an axial shortening of the creel length. However, the required shortening of the sleeve type creel is clearly less than one half of the original height of the not yet compacted thread coil. It is not possible to shorten the length of the prior art sleeve type lap creel exactly to the extent necessary for the thread coil densification.

A third distinct disadvantage of the prior art creel resides in the fact that the ribs which extend almost along the entire sleeve height or length, have the same shortening effect on each zone of the thread coil or winding when the two creel sections are pushed together, or rather, pushed into each other. A uniform shortening of the entire lap creel is not desired because the thread coil or winding requires a different densification at different zones along its height. Especially in connection with coils or windings formed by a so-called cross-type winding operation, the outer ends of the winding or coil are more densely wound than the center portion of the coil due to the reversing points of the thread. Thus, the central zone or portion of a cross-type winding requires a larger densification than the end portions of such a winding in order to achieve a uniform densification along the entire length or height of the coil or winding.

OBJECTS OF THE INVENTION

In view of the foregoing it is the aim of the invention to achieve the following objects singly or in combination:

to construct a sleeve type lap creel in such a way that it may be produced by a single mold so that costs will be especially economical and a one way use of these creels will be feasible;

to construct the lap creel in such a way that the shortening of its axial length will provide the densification of a thread coil or winding of the lap creel where the densification is necessary, namely, in the center region of the winding or coil;

to densify a wound yarn or thread coil with the aid of a lap creel according to the invention in such a way that a defined axial length reduction of the lap creel will result in a uniform density throughout the volume of the coil or winding; and to construct these lap creels so that they can be stacked even in their reduced length condition.

SUMMARY OF THE INVENTION

A sleeve type lap creel according to the invention is characterized by two axially outer sleeve sections each forming an open ended cylinder which is circumferentially closed, except for radial openings through the cylinder wall. Both cylinders or sleeve sections have an axial length corresponding, preferably, to about one third of the entire unshortened creel length. Each sleeve section is provided with axially extending, circumferentially spaced ribs forming carrier elements which lie with their radially outer surfaces on a diameter corresponding to the inner diameter of the sleeve sections so that the ribs of one sleeve may slide into the other sleeve and vice versa. Further, the sleeves of a creel are initially interconnected through the ribs by frangible bridging elements having a rated breaking point so that the bridging elements may be broken when an initial axial spacing between the first and second creel sections is changed, for example, by pushing the creel sections toward each other or rather into each other.

Thus, the lap creel according to the invention has three sections, namely the two cylinder end sections and a cage section formed by the ribs intermediate the two end sections. The length reduction is concentrated in the intermediate zone when the ribs are shortened, so to speak, in their length while moving into the respective other outer cylindrical creel section. Thus, the maximal axial length reduction of a creel according to the invention is limited by the length of the ribs which form the rib cage when the creel still has its full length and which may disappear completely when the creel has been shortened to the maximum extent.

The axially outer, cylindrical creel sections do not directly participate in the shortening of the axial creel length so that the coil or winding zones located on these outer creel sections, remain substantially undeformed which is very desirable because these outer coil or winding zones have a larger density anyway. The densification of the coil or winding is concentrated to its central zone which is also desirable because this central or intermediate zone does not have the required density. Since this central coil zone is located on the rib cage which, so to speak, disappears, the invention achieves the coil or winding densification exactly where it is needed. The most densification will be applied where the coil or winding initially has its smallest density.

BRIEF DESCRIPTION OF THE DRAWINGS

In order that the invention may be clearly understood, it will now be described, by way of example, with reference to the accompanying drawings, wherein:

FIG. 6 is a view axially onto the end of a lap creel according to the invention;

FIG. 7 is a horizontal section along section line VII—VII in FIG. 5;

FIG. 8 is a sectional view along section lines VIII—VIII in FIG. 5;

DETAILED DESCRIPTION OF PREFERRED EXAMPLE EMBODIMENTS AND OF THE BEST MODE OF THE INVENTION

Figure 1:
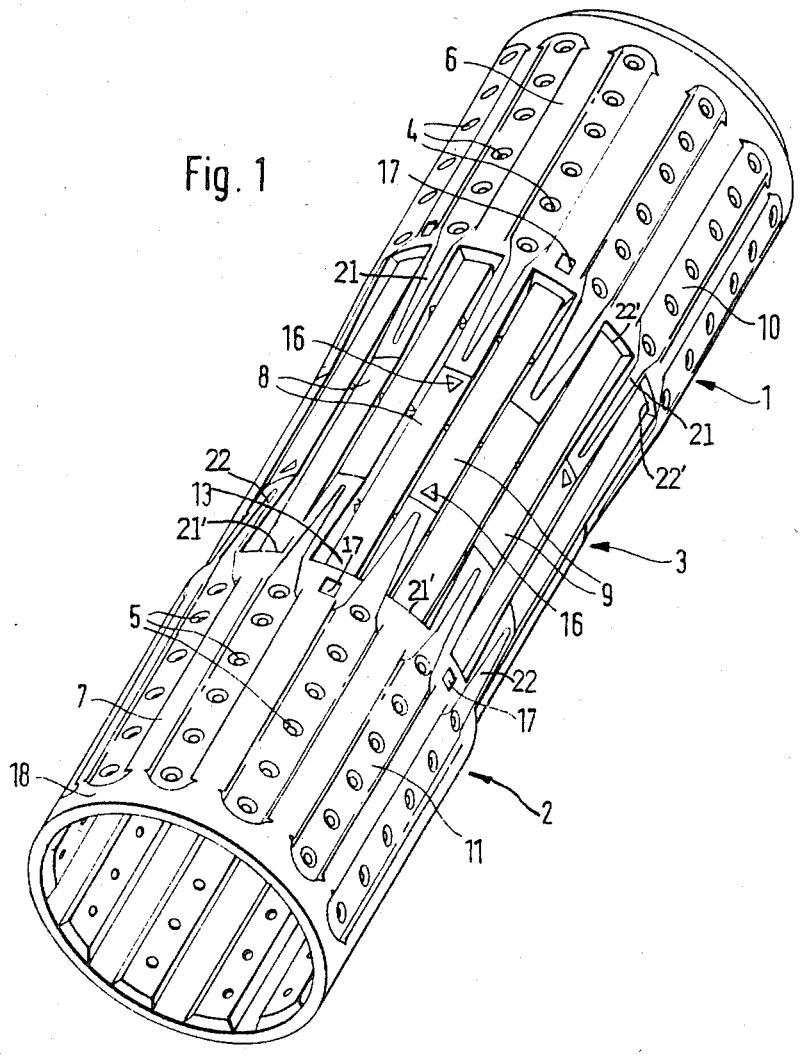
FIG. 1 is a perspective view of a lap creel according to the invention in its yet fully extended condition in which the creel has its maximum axial length.
Figure 2:
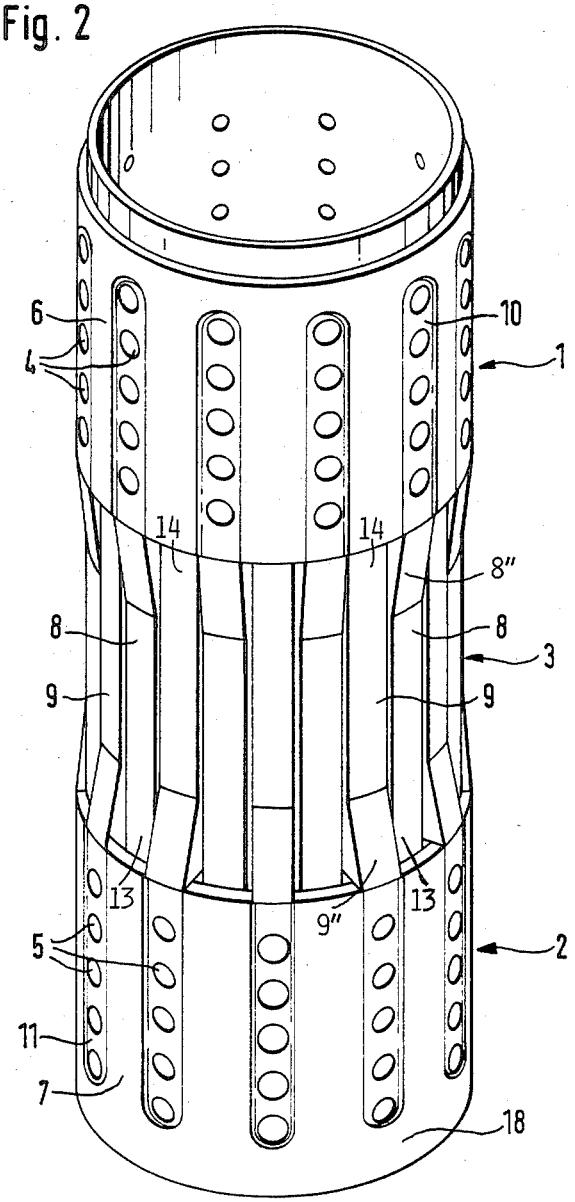
FIG. 2 is a perspective view similar to that of FIG. 1, however, illustrating a somewhat modified embodiment of the present lap creel.
Figure 3:
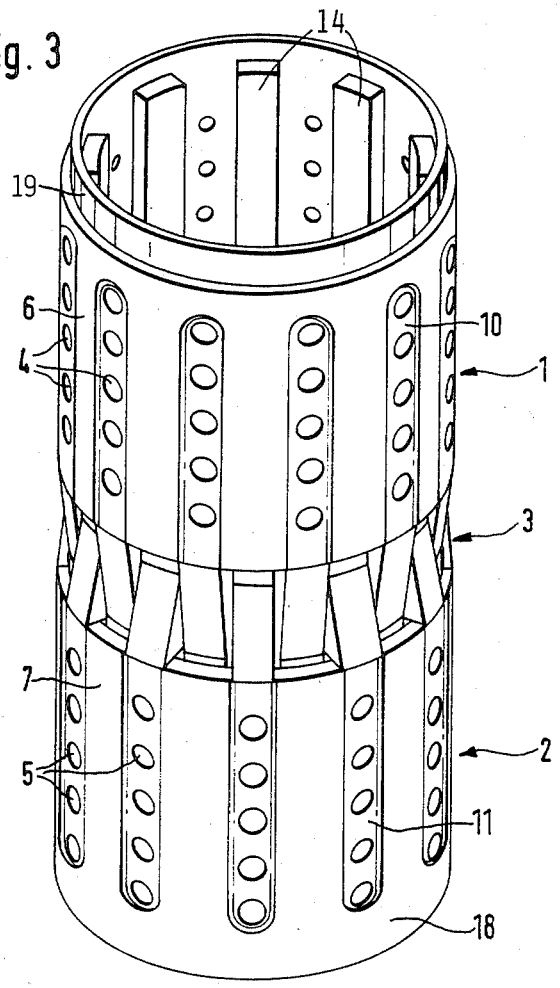
FIG. 3 is a perspective view of a lap creel according to the invention in its state of reduced length.

Referring to FIGS. 1, 2, and 3, the sleeve type lap creel according to the invention comprises two axially outer, hollow cylindrical creel or sleeve sections 1 and 2 interconnected by a rib cage 3 formed by ribs 8 and 9. The ribs 8 extend axially from the sleeve section 1. The ribs 9 extend axially from the sleeve section 2. Each rib 8, 9 has a sleeve end 21, 22 rigidly connected to the respective sleeve section 1, 2. The respective opposite ends of the ribs are either free ends or they may be connected to the other sleeve section through a frangible element 21', 22'.

The sleeve sections 1 and 2 are substantially closed hollow cylinders 6, 7 which are open at their ends and provided with openings or holes 4, 5. Each cylinder 6, 7 has an axial length corresponding to approximately one third of the entire lap creel when the lap creel is in its extended, unshortened condition as shown in FIGS. 1 and 2. The ribs 8, 9 are uniformly distributed about the circumference to form the above mentioned rib cage 3. Initially, the sleeves 6 and 7 are interconnected with each other through the ribs 8, 9 with the aid of frangible bridging members 15 shown in FIGS. 4 and 10. The axial length of the ribs 8 and 9 corresponds to approximately one third, for example, of the entire unshortened length of the present creel.

By interconnecting the creel sections 1 and 2 through the ribs 8 and 9, with the aid of the frangible elements 15, the two sections with their respective ribs may be identical to each other so that only one molding tool is necessary for producing the creel sections and ribs, preferably of a suitable synthetic material. Thus, the costs are substantially reduced. Another advantage of the single piece construction is seen in that an assembly of different creel sections is no longer necessary and that an unintended shortening of the creels is avoided because the bridging elements 15 have a rated strength breaking point 15' which will break only in response to a certain axial force applied to the ribs 8 and 9, or rather to the respective creel sections. Any force smaller than the rated force will not break the frangible briding elements 15 so that the present creel has a defined, uniform length prior to its shortening, whereby the insertion of the sleeve into a winding apparatus is facilitated even if the winding apparatus keeps operating at high r.p.m.

Figure 4:
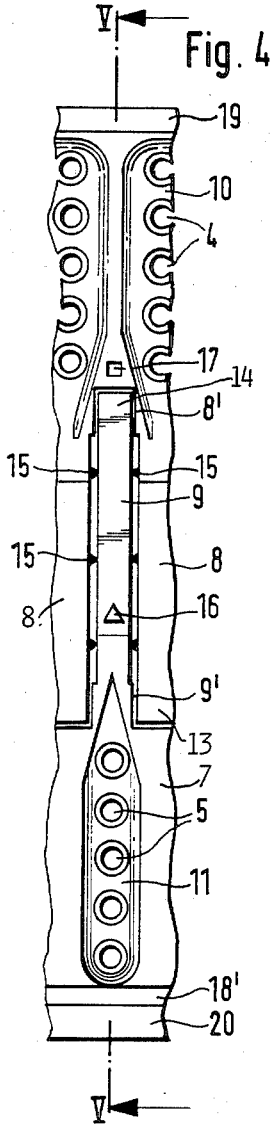
FIG. 4 is a plan or side view onto a portion of a lap creel according to the invention showing a modified rib construction as compared to FIGS. 1 to 3.
Figure 10:
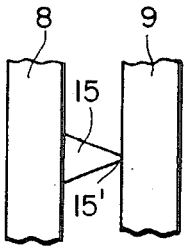
FIG. 10 shows a detail of one version of the frangible bridging elements.
Figure 11:
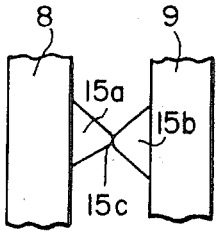
FIG. 11 shows another version of frangible briding elements.

The frangible bridging elements may be located at 21' and 22', FIG. 1, or they may be located circumferentially between adjacent ribs 8 and 9 as shown in FIGS. 4, 10, 11. Providing the bridging elements at both locations is also possible. In any event, the rated strength or force of the bridging elements will be such that placing the creels into a winding apparatus will not result in a severence, while, on the other hand, the force applied for the densification of the coil or winding must be sufficient to assure the severence. Locating the bridging elements 15 between adjacent ribs 8 and 9 as shown in FIG. 4 has been found to be rather satisfactory because the axially applied force for densifying a winding is very effective in applying the necessary shearing force to the weakest points 15', whereby the severence is accomplished without producing any waste material, and without bending the ribs since the shearing force does not need to be transmitted over the entire length of the ribs. Preferably, a plurality of bridging elements 15 are provided as shown in FIG. 4. It has been found that this arrangement of the bridging elements 15 results in a surprisingly stiff rib cage in the radial direction so that a proper winding operation is assured. Yet, a relatively small axial pressure is sufficient for the severence and the shortening of the creel length. It is advantageous that the severence does not result in waste material, as mentioned, because such waste material might contaminate the treatment medium to which the wound coils are subjected.

In the embodiment of FIG. 1, the sleeve cylinders 6 and 7 are provided with axially extending grooves 10 and 11 in which the holes or openings 4, 5 are located in a row. The ribs 8 and 9 are secured to their respective cylinder section 6, 7 so as to merge into the respective groove 10, 11 as shown at 21, 22. This feature makes sure that the holes remain unobstructed on the inside of the creel. In the embodiment of FIG. 2 there are no grooves. However, the rows of holes 4, 5 also extend in alignment with the respective rib 8, 9 to leave the holes unobstructed in the shortened state.

The free ends 13, 14 of the ribs 8, 9 are so located that they can slide into the respective other cylinder section 6, 7 when the axial pressure is applied that is required for breaking the briding elements 15. Once the bridging elements have been severed, the creel sections can be pushed together to assume the position shown in FIG. 3. In order to interlock the creel sections to each other, at least one or several of the ribs 8, 9 may be provided with projections, for example, in the form of a wedge shape 16 snapping into a recess 17 in the respective cylinder section. The projections 16 reach above the circumferential surface of the ribs radially outwardly sufficiently for the mentioned snap-fit. Thus, it is possible to positively lock the sleeve sections into their shortened position which is definitely limited by the circumferentially thickened end portions 8', 9' of the ribs 8, 9, please see FIG. 4. The formation of the ramps 8" and 9" provides an alternative possibility of limiting the insertion of the ribs into the respective cylindrical sections, please see FIGS. 2 and 3.

Referring further to FIGS. 2, 3, 4, and 5 the cylinder section 7 is provided with an end zone 18 free of holes 5 and free of grooves 11. The end zone 18 is instead provided with a circumferential groove 18' for receiving a thread end. Further, the end zone 18 has an inner female recess 20 having a diameter to snuggly receive a collar 19 provided at the opposite end of the other cylinder section 6. Thus, lap creels may be stacked by inserting the collar 19 of one creel into the recess 20 of another creel. Further, the circular surface end zone 18 provides a surface area for cooperation with a friction drive roller for driving the creels with a uniform rotation even before the first winding layer is applied to the lap creel. Once the winding operation begins, the friction roller may bear against the first winding layer.

FIGS. 6 and 7 show the relationship between the ribs 8 and 9 around the sleeve type creel with the frangible bridging elements 15 closing a circle as long as the lap creel still has the original length. FIG. 8 shows the location of the grooves 11 and the holes 5 arranged in the grooves 11. This type of construction results in a very lightweight lap creel which requires an optimally small volume of synthetic plastics material for making these creels. In spite of the low material requirement the creels have been found to have a surprisingly good stability due to the substantially closed end cylinders, except for the holes 4, 5. The good stability is present especially when the two cylinder sections have been pushed into the reduced length position, whereby the rib cage, or rather what used to be the rib cage, does not affect the rigidity of the creel anymore, so that only the end sections are exposed to the loads or forces resulting from treating the coil or winding on the creel, the sections of which have been pushed into the reduced length condition.

It is not necessary to push the creel sections or cylinders so close together that the full length of the ribs disappears. Such an extreme shortening of the creel length would require substantial forces because it would be necessary to bend the ribs radially inwardly at the points 21, 22 where they are connected to the respective creel section. Such an extreme shortening is not necessary in practice since a sufficient densification of the coil or winding is accomplished when the initial length of the creel is reduced by less than one third. Thus, the lateral widening portions 8', 9' which are provided for at least one, preferably several ribs 8, 9, provide a stop for definitely limiting the maximum shortening to a value corresponding to the length of the ribs less the widening portion 8', 9'.

Figure 9:
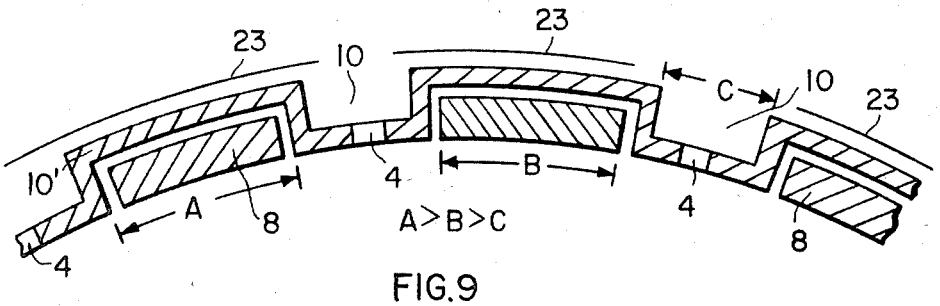
FIG. 9 is a partial sectional view approximately along section line IX—IX in FIG. 5 on an enlarged scale and showing the creel in its shortened condition.

The above mentioned grooves 10 and 11 make sure that any winding or coil 23 rests only on the portions 10' of the cylindrical sections between the grooves 10 or 11, please see FIG. 9. Thus, the treatment medium can pass through the holes 4, 5 and the grooves 10 directly into contact with the coil or winding 23, whereby a uniform dyeing of the coil is achievable.

Figure 5:
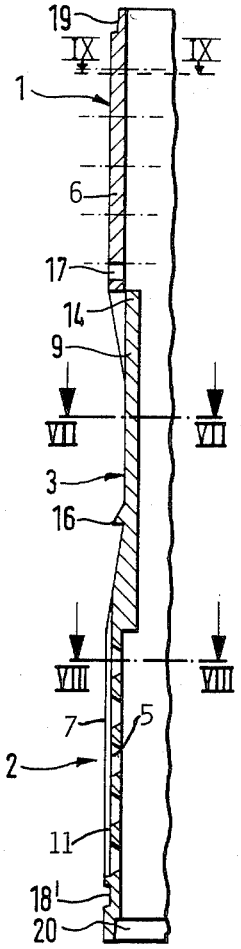
FIG. 5 is a sectional view along section line V—V in FIG. 4.
Figure 12:
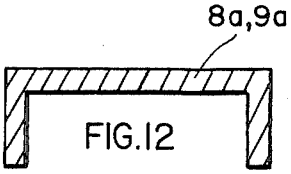
FIG. 12 shows a rib having an inverted, approximately U-shaped cross-section.

As shown in FIGS. 4 and 5 it is advantageous to align the grooves 10, 11 with the respective ribs 8, 9 because this arrangement simplifies the mold needed for casting or injection molding these creel sections. Further, the stiffness of the ribs can be increased by providing the ribs with a U-cross-sectional shape as shown in FIG. 12, whereby the ribs 8*a*, 9*a* have legs which are directed radially inwardly of the creel. Thus, the radially outwardly facing surface of the U-cross-section participates substantially along its entire length in the formation of the jacket of the rib cage, whereby the outer diameter of the jacket is adapted to the inner diameter of the hollow cylindrical creel sections 6, 7 for inserting the ribs into the respective creel section. The U-cross-sectional shape prevents the ribs from deflecting and thus facilitates the sliding of the ribs into the creel sections when the creel is to be shortened.

FIG. 9 further shows that the grooves 10 or 11 are circumferentially spaced from each other by a spacing A which is larger than the circumferential width B of the ribs. Further, the grooves 10, 11 have a circumferential dimension C, whereby the spacing A is larger than the width B which in turn is larger than the dimension C so that the ribs 8 or 9 fit into the respective spacing.

As best seen in FIG. 9, the cylindrical sleeves with their grooves 10, 11 and wall portions 10' are so constructed that the wall thickness of the cylindrical sleeve is substantially uniform throughout the entire creel section. A uniform wall thickness simplifies the production and is advantageous for the radial stiffness of the sleeve sections.

Incidentally, due to the grooves 10, 11 it is possible to lift the winding 23 off the wall portions 10' sufficiently by supplying the treating medium with sufficient pressure through the holes 4 from the inside of the creel radially outwardly. Thus, a uniform treatment such as dyeing is assured.

FIG. 11 shows a modification of the frangible bridging elements. The modification comprises two conically shaped bridging portions 15*a* and 15*b* connected at a needle point 15*c* which is so dimensioned that the above considerations are satisfied, namely that the force needed for the axial compression of a coil or winding is sufficient to break the needle point junction 15*c* while the forces involved in handling the creel are insufficient to break these bridging elements.

By keeping the end portions 18 of the creel sections free of the grooves 10, 11 and of the holes 4, 5, the radial stability of the creel sections is assured even if the wall thickness, though uniform, is relatively small.

By arranging the ring groove 18' as described above, a thread reserve of a thread end may be located in these grooves and will remain accessible even after the creel sections have been pushed together into the shortened state so that a thread end of one coil or winding can be connected to the thread beginning of the next following coil.

The above mentioned collar 19 fits snuggly into the inner diameter recess 20 so that stacked creels are properly centered relative to a common longitudinal axis. If desired, stacked creels may be solidly interconnected in a coaxial arrangement to form a creel unit comprising several individual creels, whereby a plurality of coils may be wound onto such creel unit, or a continuous large coil may be wound.

Although the invention has been described with reference to specific example embodiments, it will be appreciated, that it is intended to cover all modifications and equivalents within the scope of the appended claims.

What we claim is:

1. A lap creel having a changeable axial length, comprising a first axially outer creel section with radially extending openings therein, a second axially outer creel section also with radially extending openings therein, each of said first and second axially outer creel sections forming a hollow cylinder having a given open inner diameter, said lap creel further comprising a first group of circumferentially spaced ribs extending axially from the first creel section to the second creel section and a second group of circumferentially spaced ribs extending axially from the second creel section to the first creel section whereby the ribs of one creel section fit into spacings between the ribs of the other creel section and vice versa, said first and second groups of ribs forming a rib cage having radially outer support surfaces defining an outer diameter smaller than said given open inner diameter of said first and second creel section so that said ribs can fit into the creel sections, and frangible bridging elements interconnecting said first and second creel sections through said ribs, whereby said bridging elements may be broken, when an initial axial spacing between said first and second creel sections is changed.

2. The lap creel of claim 1, wherein said lap creel has a given initial maximum axial length, wherein each creel section has an axial length corresponding to about one third of said maximum axial length, and wherein a fully reduced axial length of the lap creel corresponds to about two thirds of said maximum axial length.

3. The lap creel of claim 1, wherein said ribs have fixed ends permanently secured to one of said axially outer lap creel sections and opposite ends connected to the other axially outer lap creel section by said frangible bridging elements.

4. The lap creel of claim 1, wherein said ribs have fixed ends permanently secured to one of said axially outer lap creel sections and opposite free ends reaching to the other axially outer lap creel section, said frangible bridging elements being arranged between neighboring, longitudinal, circumferentially facing sides of said ribs for interconnecting said first and second creel sections.

5. The lap creel of claim 4, wherein said frangible briding elements are distributed along said ribs, and wherein each frangible elements has a needle tip and a base, said needle tip being connected to one rib of a pair of neighboring ribs and said base being connected to the other neighboring rib.

6. The lap creel of claim 4, wherein said frangible bridging elements are distributed along said ribs, and wherein each frangible element has two bases and a minimum cross-section intermediate said two bases, each base being connected to the respective rib of a pair of neighboring ribs.

7. The lap creel of claim 1, wherein said ribs have fixed ends permanently secured to one of said axially outer lap creel sections and opposite ends reaching to the other axially outer lap creel, at least one of said fixed ends in each creel section having a widened portion arranged in such a way that a widened portion of one fixed rib end in one creel section is located next to an opposite end of the other creel section and vice versa.

8. The lap creel of claim 7, wherein said widened portions are provided on both sides of said fixed ends, said widened portions facing in the circumferential direction, so that said opposite ends of one creel section are located between widened portions of the other creel section and vice versa.

9. The lap creel of claim 1, wherein said hollow cylinders forming said axially outer creel sections have axially extending grooves reaching radially inwardly, said grooves being uniformly distributed about the circumference of the respective hollow cylinder, said ribs extending axially out of the respective grooves, said ribs having a radially inwardly open U-cross-section with rib sides reaching radially inwardly.

10. The lap creel of claim 1, wherein at least one of said radially outer support surfaces of said ribs comprises an approximately radially outwardly extending projection, wherein said sleeve sections comprise at least one aperture, arranged for engagement by said projection when said first and second sleeve sections are moved toward each other for establishing a defined shortened axial length of said lap creel.

11. The lap creel of claim 1, wherein said hollow cylinders of said axially outer creel sections have axially extending grooves reaching radially inwardly, said grooves being circumferentially spaced from each other by a spacing A, said ribs having a circumferential width B, said grooves having a circumferential dimension C, wherein said spacing A is larger than said width B, said width B being larger than said dimension C, thus $A>B>C$ so that said ribs fit into said spacings.

12. The lap creel of claim 11, wherein said hollow cylinders have a substantially uniform wall thickness in said grooves and between said grooves.

13. The lap creel of claim 11, wherein said grooves have groove bottoms, said radially extending openings of said first and second creel sections extending through said groove bottoms, said radially extending openings being arranged in a row along each groove bottom.

14. The lap creel of claim 13, wherein each of said first and second lap creel sections has an axially outer end rim portion without openings, said rows of openings extending from said end rim portion approximately to a respective rib.

15. The lap creel of claim 13, further comprising a radially outwardly open, circumferentially extending groove in said end rim portion for holding a thread end.

16. The lap creel of claim 1, wherein each of said first and second creel sections has a collar at its axially outer end, one collar having an open inner diameter, the other collar having an outer diameter fitting into said open inner diameter for stacking a plurality of lap creels.

* * * * *